US009670770B2

(12) United States Patent
Mekic et al.

(10) Patent No.: US 9,670,770 B2
(45) Date of Patent: Jun. 6, 2017

(54) FRACTURE EVALUATION THROUGH CASED BOREHOLES

(71) Applicants: Natasa Mekic, Denver, CO (US); Douglas J. Patterson, Spring, TX (US)

(72) Inventors: Natasa Mekic, Denver, CO (US); Douglas J. Patterson, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 386 days.

(21) Appl. No.: 14/309,351

(22) Filed: Jun. 19, 2014

(65) Prior Publication Data

US 2015/0013974 A1 Jan. 15, 2015

Related U.S. Application Data

(60) Provisional application No. 61/838,656, filed on Jun. 24, 2013.

(51) Int. Cl.

| | |
|---|---|
| ***E21B 47/00*** | (2012.01) |
| ***E21B 47/10*** | (2012.01) |
| ***E21B 43/26*** | (2006.01) |

(52) U.S. Cl.

CPC ..... *E21B 47/101* (2013.01); *E21B 43/26* (2013.01)

(58) Field of Classification Search

CPC ..... E21B 47/101; E21B 43/26
USPC ..... 166/72, 254.1; 367/31
See application file for complete search history.

(56) References Cited

U.S. PATENT DOCUMENTS

| | | | |
|---|---|---|---|
| 4,881,208 | A | 11/1989 | Liu |
| 2004/0001388 | A1 | 1/2004 | Kriegshauser et al. |
| 2006/0106542 | A1 | 5/2006 | Haugland |
| 2009/0005995 | A1 | 1/2009 | Tang et al. |

FOREIGN PATENT DOCUMENTS

| | | | |
|---|---|---|---|
| WO | 9206391 | A1 | 4/1992 |

OTHER PUBLICATIONS

Notification of Transmittal of the International Search Report and the Written Opinion of the International Searching Authority, or the Declaration; PCT/US2014-043378; Oct. 20, 2014, 15 pages.

Patterson, et al., "Unconventional Reservoir Fracture Evaluation Utilizing Deep Shear-Wave Imaging", SPWLA 58nd Annual Logging Symposium, May 14-18, 2011, 16 pages.

Tang, et al., "Evaluating Hydraulic Fracturing in Cased Holes Using Cross-dipole Acousitc Technology", SPE 56512, 1999 SPE Annual Technical Conference and Exhibition, Houston, Texas, Oct. 3-6, 1999. 11pages.

*Primary Examiner* — Daniel L Murphy
(74) *Attorney, Agent, or Firm* — Cantor Colburn LLP

(57) ABSTRACT

A method of estimating fractures in an earth formation includes: disposing an acoustic tool in a cased borehole in an earth formation, the acoustic tool including a multipole acoustic transmitter and an acoustic receiver; transmitting an acoustic signal into the borehole; measuring deep shear wave (DSW) signals generated from shear body waves reflected in the formation in a far-field region of the formation around the borehole; and estimating at least a location and an orientation of a fracture in the formation based on the DSW signals.

20 Claims, 6 Drawing Sheets

FRACTURE EVALUATION THROUGH CASED BOREHOLES

CROSS-REFERENCE TO RELATED APPLICATIONS

This application claims the benefit of Provisional Application No. 61/838,656 filed Jun. 24, 2013, the disclosure of which is incorporated by reference herein in its entirety.

BACKGROUND

Hydrocarbons are typically recovered by having fluids containing or comprising such hydrocarbons flow out of reservoirs in a formation and into a borehole that penetrates the formation. Hydraulic fracturing and other stimulation techniques may be applied to the formation to facilitate removal of hydrocarbons by fracturing the formation and/or extending existing fractures in the formation. Evaluation of the extent, complexity and orientation of fractures is of importance in effectively managing such operations and assessing hydraulic fracturing operations.

SUMMARY

An embodiment of a method of estimating fractures in an earth formation includes: disposing an acoustic tool in a cased borehole in an earth formation, the acoustic tool including a multipole acoustic transmitter and an acoustic receiver; transmitting an acoustic signal into the borehole; measuring deep shear wave (DSW) signals generated from shear body waves reflected in the formation in a far-field region of the formation around the borehole; and estimating at least a location and an orientation of a fracture in the formation based on the DSW signals.

An embodiment of an apparatus for estimating fractures in an earth formation includes: an acoustic tool configured to be disposed in a cased borehole in an earth formation, the acoustic tool including a multipole acoustic transmitter and an acoustic receiver, the acoustic tool configured to transmit an acoustic signal into the borehole, and measure deep shear wave (DSW) signals generated from shear body waves reflected in the formation in a far-field region of the formation around the borehole; and a processor configured to estimate at least a location and an orientation of a fracture in the formation based on the DSW signals.

BRIEF DESCRIPTION OF THE DRAWINGS

The following descriptions should not be considered limiting in any way. With reference to the accompanying drawings, like elements are numbered alike.

DETAILED DESCRIPTION

There is provided a system and method for performing, evaluating and improving formation stimulation. An embodiment of a method includes performing Deep Shear Wave (DSW) imaging through a cased or open hole prior to a hydraulic fracturing operation and/or performing DSW imaging through a cased hole after a hydraulic fracturing operation to evaluate the effectiveness of the operation and/or adjust or improve fracture models and operations.

Figure 1:
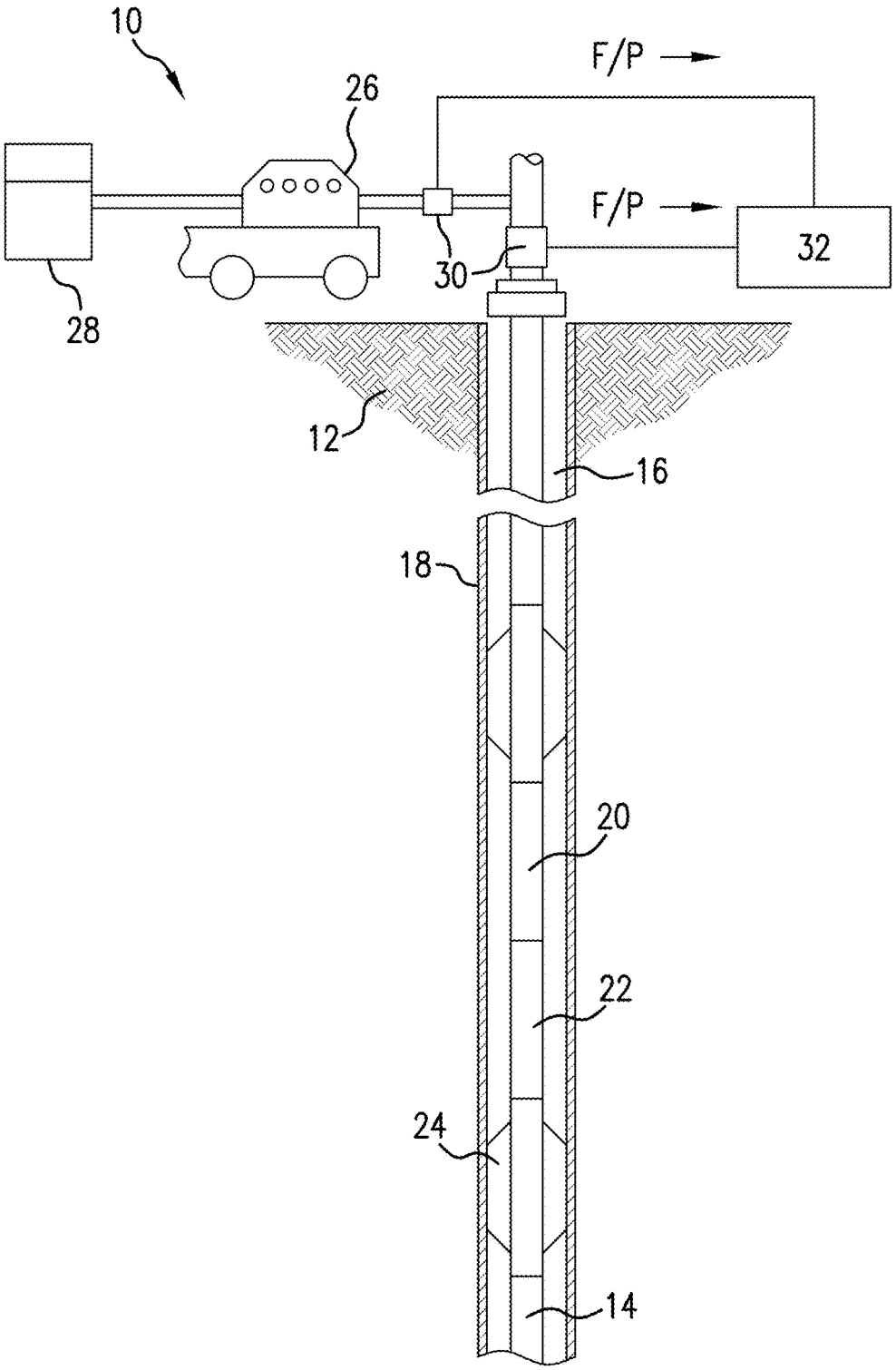
FIG. 1 depicts an embodiment of an earth formation stimulation system.

FIG. 1 illustrates aspects of an exemplary embodiment of a system 10 for hydrocarbon production, stimulation and/or measurement of an earth formation 12. The system 10 includes a borehole string 14 such as a stimulation string, wireline or other carrier disposed within a borehole 16 that is suitable for lowering a tool or other component through a borehole or connecting a component to the surface. The term "carrier" as used herein means any device, device component, combination of devices, media and/or member that may be used to convey, house, support or otherwise facilitate the use of another device, device component, combination of devices, media and/or member. Exemplary non-limiting carriers include casing pipes, wirelines, wireline sondes, slickline sondes, drop shots, downhole subs, BHA's, frac ports and drill strings.

In one embodiment, the system 10 is configured as a hydraulic stimulation system. As described herein, "stimulation" may include any injection of a fluid into a formation. An exemplary stimulation system may be configured as a cased or open hole system for initiating fractures and/or stimulating existing fractures in the formation. A fluid may be any flowable substance such as a liquid or a gas, and/or a flowable solid such as sand.

In this embodiment, the borehole 16 includes a casing 18, and the string 14 includes one or more tools or components to facilitate stimulation of the formation 12. For example, the string 14 includes a fracturing assembly 20 including, e.g., injection nozzles and mechanical valve devices such as frac sleeves and/or drop-ball devices. The string 14 may also include a perforation assembly 22. The string may also include additional components, such as one or more isolation or packer subs 24. In the embodiment shown in FIG. 1, the system is configured to stimulate the formation 12, but is not so limited. The system may be configured to perform various functions, such as downhole measurements and hydrocarbon production.

One or more of the fracturing assembly 20, the perforation assembly 22 and/or packer subs 24 may include suitable electronics or processors configured to communicate with a surface processing unit and/or control the respective component or assembly.

In one embodiment, the system 10 is a hydraulic fracturing system that includes an injection device such as a high pressure pump 26 in fluid communication with a fluid tank 28 or other fluid source. The pump 26 injects fluid into the string 14 to introduce fluid into the formation 12, for example, to stimulate and/or fracture the formation 12.

Various measurement and/or control devices may be included to monitor and/or control a stimulation or hydraulic fracturing operation. For example, one or more flow rate and/or pressure sensors 30 may be disposed in fluid communication with the pump 26 and the string 14. The sensors 30 may be positioned at any suitable location, such as proximate to or within the pump 26, at or near the wellhead. The types of sensors described herein are exemplary, as various types of sensors may be used to measure various parameters.

A processing and/or control unit 32 is disposed in operable communication with at least the sensors 30 and the pump 26. The processing and/or control unit 32 is configured to receive, store and/or transmit data generated from the sensors 30 and/or the pump 26, and includes processing components configured to analyze data and/or control operational parameters. The processing and/or control unit 32 includes any number of suitable components, such as processors, memory, communication devices and power sources.

Figure 2:
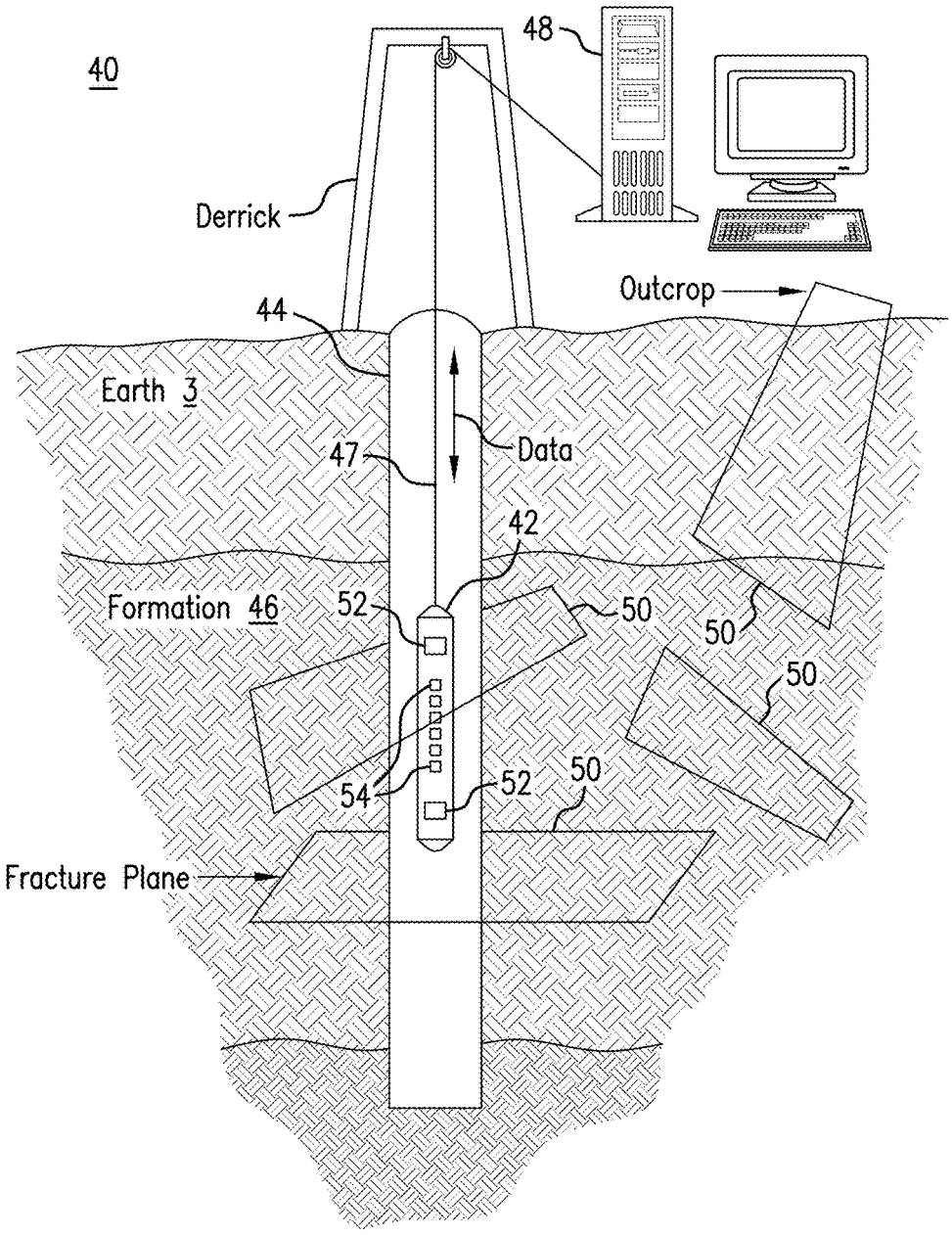
FIG. 2 depicts an embodiment of a system for monitoring seismic activity in a formation.

FIG. 2 illustrates an embodiment of a measurement and/or monitoring system 40. The system 40 includes a data acquisition tool 42 disposed in a borehole 44 in a formation 46. The data acquisition tool 42 is configured to monitor and/or collect data related to stimulation operations, such as those performed via the system 10. The tool 42 may be deployed downhole via any suitable carrier as shown in FIG. 2, may be disposed at a surface (e.g., as part of a surface seismic array), and/or configured to operate in conjunction with other downhole or surface tools. In the embodiment shown in FIG. 2, the carrier is a wireline 47, which provides support for the tool 42 and also provides communications between the downhole tool 10 and a surface processing unit 48. In one embodiment, the tool 42 is disposed in an earth formation via the cased borehole prior to a fracturing operation (e.g., performed via system 10) and/or after the fracturing operation to evaluate the operation. It is noted that although the embodiments described herein are described in conjunction with vertical wells, they are not so limited, as they could be used with horizontal wells and/or wells having horizontal sections or sections that otherwise deviate from a vertical direction.

The earth formation 46 may include a reservoir of hydrocarbons or other fluids of interest disposed in rock pores. Also illustrated is a plurality of rock fractures 50 in the earth formation 46. The fractures can be natural fractures, fractures stimulated by hydraulic fracturing or a combination. The data acquisition tool 42 is configured to measure properties of the formation 46 including characteristics of the fractures 50 (e.g., fracture orientation, fracture size, fracture intensity, fracture transmissivity, or fracture aperture). Non-limiting embodiments of measurements performed by the data acquisition tool 42 include seismic, acoustic, pulsed-neutron, resistivity, radiation, survey and imaging.

In one embodiment, the tool 42 and/or the system 40 is configured for acoustic monitoring of the formation 12 before and after a fracturing operation. The tool 42 includes acoustic monopole and/or multipole transmitters 52 that emit acoustic energy pulses that typically travel radially outwardly from the transmitters. Multiple oriented transmitters may be disposed at the location shown at 52. One or more acoustic receivers 54, such as an axial array of receivers 54, are positioned along the tool 42.

The tool 42 may be configured to evaluate the formation using one or more of various techniques. Such techniques include monopole techniques such as Borehole Acoustic Reflection Surveys (BARS). Other techniques include dipole techniques such as cross-dipole imaging and Deep Shear Wave Imaging (DSWI).

BARS imaging techniques utilize a monopole source with azimuthal receivers to provide directional sensitivity. The monopole source in a borehole produces multiple modes (compressional, shear, and Stoneley). All of these modes are suppressed in order to look at reflected wave events. Monopole tools are typically limited to high frequency of around 10 kHz, which can provide a severe limitation due to formation attenuation. The BARS imaging technique uses P waves which produce a relatively complex reflected wavefield (P to P and P-S reflected along with the P-P and P-S refracted).

For dipole configurations, an exemplary tool 42 uses one or more dipole sources that transmit energy into the borehole and the formation. For example, the dipole source transmits in a direction "x" extending away from the borehole, which is typically perpendicular or substantially perpendicular to the borehole and/or the tool 42 orientation, described in this example as the "z" direction. Flexural waves are generated that typically can reflect and provide readings out to around 2-4 feet into the formation. Waves that are radiated away from the borehole and travel farther into the formation are referred to as body waves, which can be reflected back to the borehole and are detected as signals that are late-arriving and faint relative to the reflected flexural wave signals. The region around the borehole can be divided into a near-field region that extends laterally (e.g., perpendicular to the borehole axis) to a first distance from the borehole, and a far-field region that extends laterally from the first distance to a second distance. In one embodiment, the near-field region extends from the borehole to the furthest distance that flexural waves can extend and return detectable reflected signals, and the far-field region extends to a further lateral distance.

For example, the transmitter 52 includes a dipole source that generates two different types of shear body waves in the formation. A vertically oriented shear wave (SV) is aligned with the dipole source and polarized in the "x" direction, and a horizontally oriented shear wave (SH) is polarized in the "y" direction. Energy reflected back from these waves can provide information for fractures that, in one embodiment, are oriented such that the angle between the reflecting fracture and the borehole axis (e.g., the z-axis) is about 60-70 degrees or less.

Cross-dipole measurements provide information regarding the shear-wave anisotropy around the borehole by measuring the difference between the fast and slow wave velocity difference. Azimuthal shear-wave anisotropy around the borehole is created by natural or stimulated fractures, which may be parallel to or intersecting the borehole. During cross-dipole logging, the borehole flexural wave motion induced by the transmitter splits into fast and slow waves, which are received by inline and cross-line receiver arrays in the tool. The inline and cross-line receiver arrays acquire two in-line and two-cross-line data sets that are processed with an array waveform inversion method to give the azimuth and magnitude of the anisotropy.

Cross-dipole acoustic imaging can be used to detect vertical and lateral extent as well as azimuth of natural and hydraulically stimulated fractures (i.e., hydraulic fractures) in the near-field (e.g., about 2-4 feet). The estimated amount of anisotropy gives a measure of fracture intensity and the associated azimuth gives the fracture strike direction. Fracture induced anisotropy can be measured through either open- or cased holes using cross-dipole acoustic logging. One consideration is that the azimuth determination in a cased hole vertical well includes the use of a gyro, however if the well is deviated the borehole high side (e.g. Relative Bearing) may be used as a reference.

DSWI is a processing technique that uses data generated from cross-dipole source. A DSWI processing technique uses shear body waves that radiate into the formation and are reflected by fractures in the formation. The far-field is typically tens of feet away from the borehole and may extend as far as, e.g., 60 feet and more. The anisotropy and azimuth can be used to estimate the location, intensity and strike (azimuth) of natural and/or stimulated fractures. Such information is useful in determining fracture height, length and extent in a formation. For example, in evaluating the results of stimulation operations, DSWI can be used to estimate hydraulic fracture height (HFH) and length (HFL), and/or the lateral extent of fractures into the far-field or Stimulated Reservoir Area (SRA). In one embodiment, DSWI is not used to detect the height of a hydraulic fracture generated at the wellbore.

The DSWI processing technique has only one direct wave mode that must be suppressed. In addition, the dipole source used for DSWI operates at a much lower frequency of 2-3 kHz, which allows a much deeper depth of investigation. In addition, improved results can be achieved by only looking at reflected shear waves, which have a greater sensitivity to fractures. Thus, DSWI allows for effective imaging at greater distances from a cased borehole than is possible with cross-dipole and other imaging techniques.

The DSWI technique can be used in conjunction with other techniques for fracture evaluation, such as ultrasonic imaging, Stoneley permeability analysis, and azimuthal shear-wave anisotropy evaluation from cross-dipole, that typically investigate a limited area around a well, e.g., 2-4 ft.

In one embodiment, various conditions are considered when performing DSWI measurements. A good casing-cement bond should be present, and fluid must be in the borehole. Poor casing-cement bond may produce casing flexural wave and contaminate formation "refracted" but not reflected body shear wave signal. The formation is preferably a "fast" formation. The dipole tool should be centered in the borehole. A decentered dipole tool in cased holes may produce additional unwanted modes complicating the analysis.

The hydraulic fracture geometry may affect DSWI. For example, a fracture generated "at the wellbore" will not be able to be imaged using DSWI unless the angle between the borehole or tool axis and the fracture (e.g., the vertical projection of the fracture on the x-y plane) is larger than zero, however, anisotropy can still be detected.

Typically, a fracture that intersects the borehole is imaged by DWSI if the angle between the borehole axis and the fracture is non-zero and about 60-70 degrees or less. Fractures that are offset and have a zero degree angle relative to the borehole are best suited for imaging. This feature allows for the imaging of complex fracture systems away from the borehole since the shear impedance contrast created by the stimulation can be illuminated.

Figure 3:
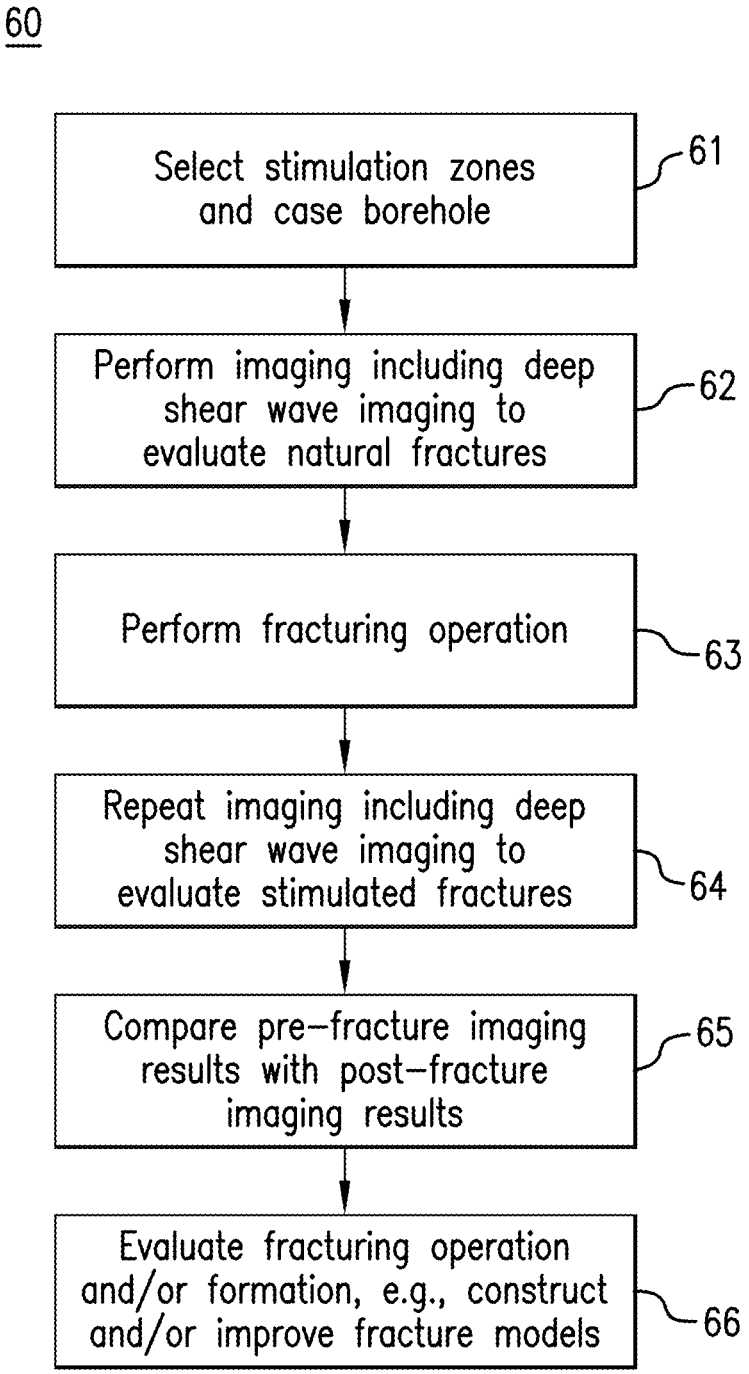
FIG. 3 is a flow chart illustrating an embodiment of a method of evaluating a fracture network in a formation.

FIG. 3 illustrates a method 60 for evaluating fractures in a formation, evaluating fracturing operations, imaging a formation and/or modeling fractures in a formation. The method 60 includes one or more stages 61-66. The method 60 is described herein in conjunction with a processor (e.g., the processing unit 48 and/or the processing unit 32) that receives signal data related to a fracturing operation, but is not so limited, and can be performed in conjunction with any number of processing devices. In one embodiment, the stages 61-66 are performed in the order described, although some steps may be performed in a different order or one or more steps may be omitted.

In the first stage 61, one or more zones or sections of the borehole are selected for stimulation, e.g., using various open hole logging operations. In one embodiment, after zones of interest are found, casing is run into the borehole and cemented.

In the second stage 62, prior to stimulation or fracturing, natural fractures in the formation are imaged by generating acoustic signals from a multipole source, e.g., the dipole source or transmitter 52. In one embodiment, imaging of the natural fractures is performed through a cased hole. In another embodiment, imaging is performed through an open hole, which may then be cased prior to the stimulation operation.

DSW imaging is performed by running an appropriate logging tool, such as the tool 42, through the cased hole and imaging natural fractures are imaged. The DSW information is used to estimate the azimuth of the strike orientation of natural and hydraulic fractures in the far-field from the wellbore. The amount of anisotropy (variation in a given direction) detected by the DSW imaging gives a measure of fracture intensity, and the azimuth gives the fracture strike direction. A tool such as a gyroscope may optionally be used to measure the azimuth of the tool 42.

In one embodiment, DSW imaging is performed in the far-field in conjunction with another imaging technique. For example, DSWI is used for the far-field, and cross-dipole acoustic measurements are performed in the near-field. The cross-dipole logging is performed using an acoustic tool with gyroscope to measure the tool azimuth inside the cased borehole.

In the third stage 63, a stimulation operation is performed. For example, the borehole is perforated using the system 10 and fluid is pumped into the borehole to hydraulically fracture the formation.

In the fourth stage 64, DSW imaging is repeated after the hydraulic fracturing operation is complete. This second DSWI procedure may be used to evaluate the effectiveness of the fracturing operation and/or to evaluate the formation, e.g., by modeling the formation or improving existing models.

In one embodiment, DSWI is performed in conjunction with acoustic cross-dipole logging after fracture stimulation. These post-fracture imaging results can be compared with the pre-fracture imaging results.

In one embodiment, the post-fracture imaging is used to calculate the hydraulic fracture height (HFH) and length (HFL) and Stimulated Rock Area (SRA). These calculations may be performed in principal directions such as N-S (North-South) and E-W (East-West).

By combining the DSW imaging with cross-dipole anisotropy result (or other near-field imaging technique), the location, orientation and magnitude of fractures in the formation can be evaluated in both the far-field and near-field around the borehole. This provides a more complete picture of the fracture intensity and complexity before and after fracturing, and thus provides a more complete evaluation of the effectiveness of the fracturing operation.

In the fifth stage 65, pre- and post-fracture images are compared to evaluate the effectiveness of the operation, to generate a model of the formation, and/or to improve an existing model or image.

In one embodiment, the strike orientation and azimuth estimated from the pre-fracturing and/or post-fracturing measurements are evaluated to estimate the number and extent of natural fractures and/or stimulated fractures. This information may be used to evaluate the effectiveness of the fracturing operation and/or make adjustments to subsequent fracturing operations.

In one embodiment, the measurements are used to generate or improve a model of the formation and/or fractures, such as a discrete fracture network (DFN) model, geological model or other mathematical model of the formation. For example, images taken before and after the fracturing operation are used to re-evaluate geomechanical properties of the formation and/or create new models.

DSW imaging pre-and-post fracture results may be used in Fracture Stimulation Modeling and Design as part of the planning phase for wellbore completions. Such planning includes predicting hydraulic fracture height as well as fracture length and/or stimulated reservoir area away from the borehole.

Existing software typically uses models based on homogenous formations, but can apply heterogeneous model assumptions. From here, DSWI is able to provide three critical parameters for a fracture model (HFH, HFL and SRA) that are the true response of the formation. This process removes at least some uncertainty caused by mathematical modeling assumptions and dramatically improves hydraulic fracturing stimulation solutions.

Figure 4:
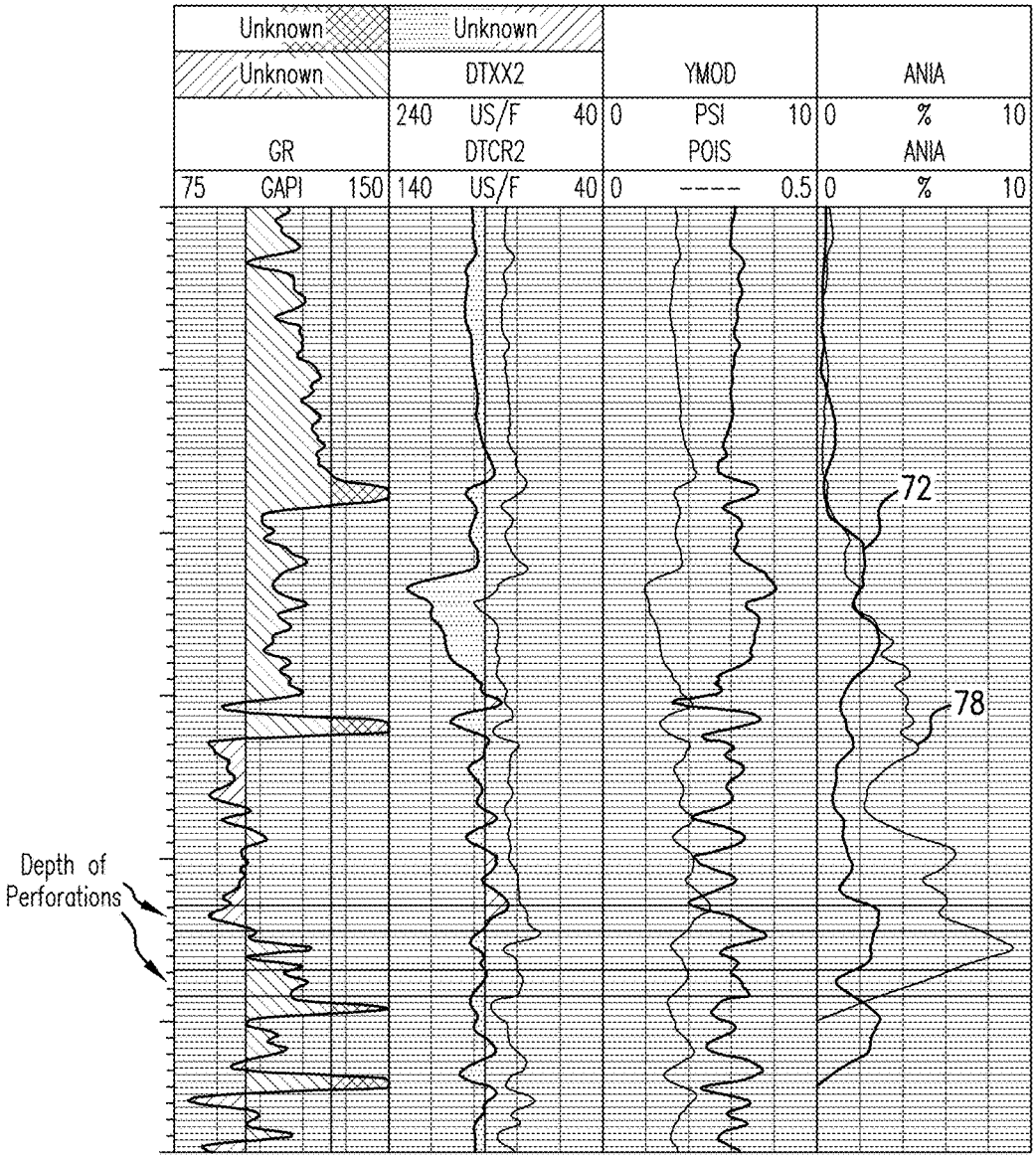
FIG. 4 depicts results of an exemplary formation stimulation and evaluation operation.
Figure 5:
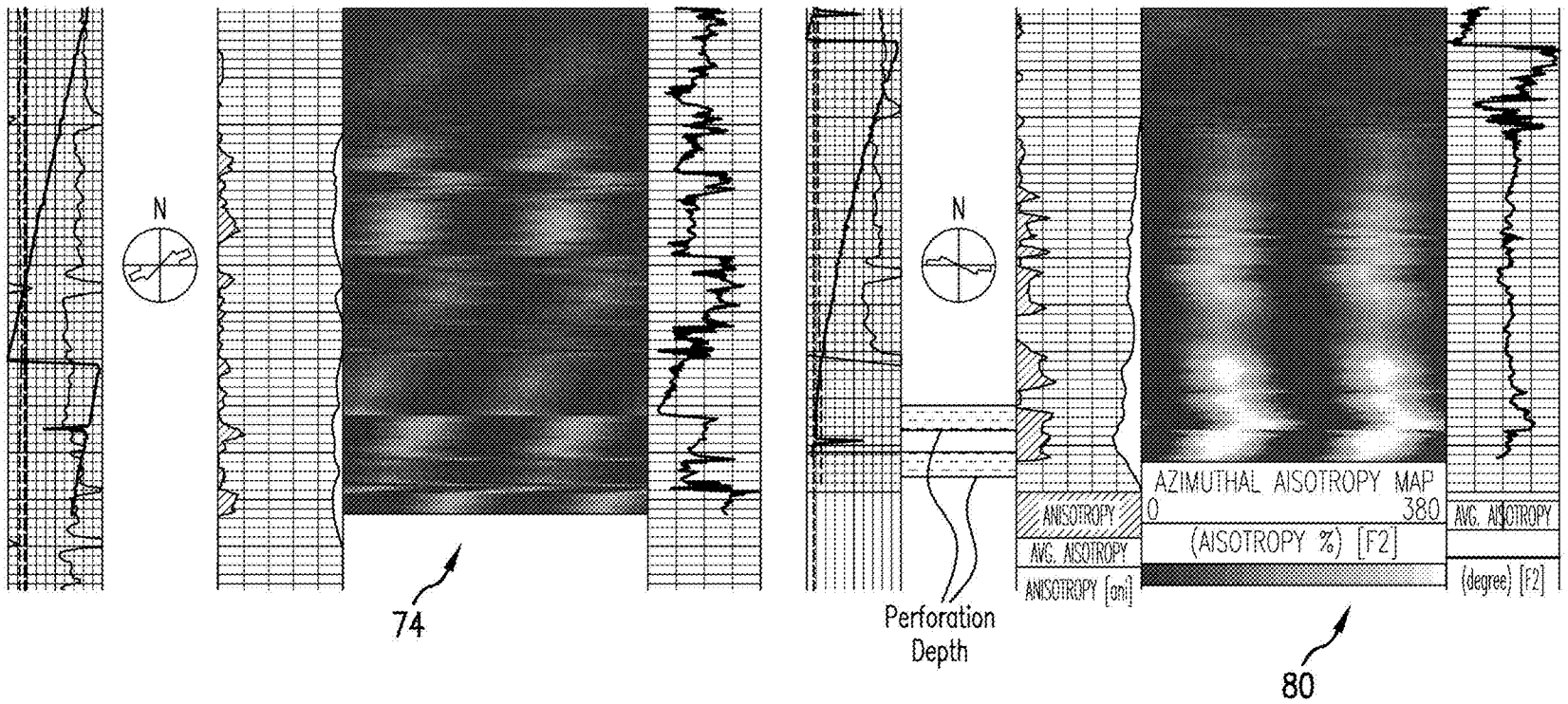
FIG. 5 depicts results of the exemplary formation stimulation and evaluation operation of FIG. 4.
Figure 6:
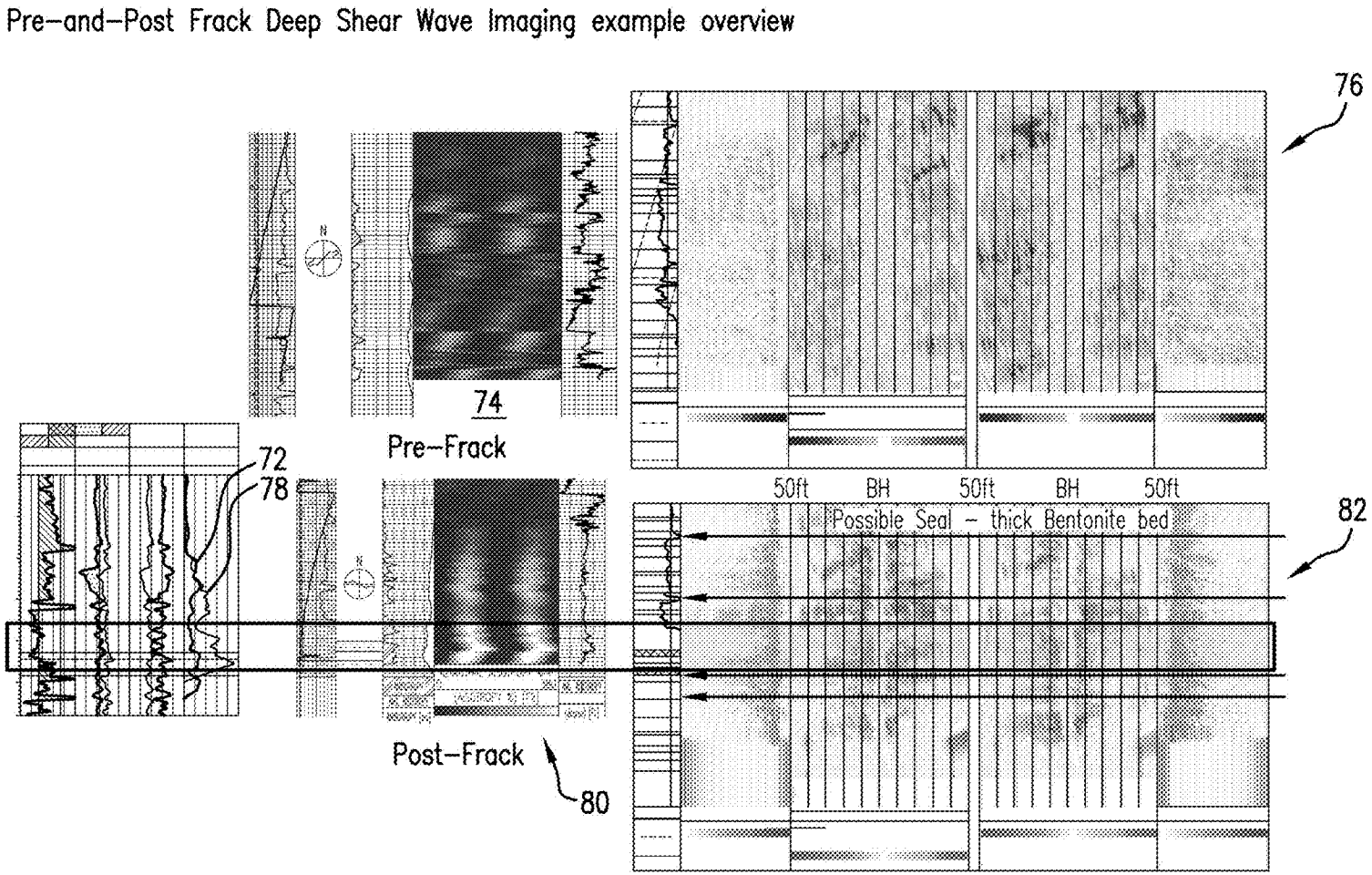
FIG. 6 depicts results of the exemplary formation stimulation and evaluation operation of FIG. 4.

FIGS. 4-6 illustrate an exemplary application of the method 60 to a formation of Mowry shale (highly siliceous organic rich shale). This example describes an evaluation of the formation to understand elastic properties of Mowry shale, define fracture height for improving Fracture Stimulation Design, and define the Mowry shale stimulated rock area.

In this example, an acoustic tool including dipole transmitters and receiver arrays was run through a cased borehole. Cross-dipole acoustic imaging was performed as described above, in conjunction with gyroscope measurements, to evaluate the amount of anisotropy around the borehole in the near-field. Deep Shear Wave Imaging (DSWI) was used to image natural fractures in the formation in the far-field, i.e., tens of feet away from the borehole, including the fractures' strike azimuth. After fracture stimulation, the cross-dipole and DSW imaging was performed again in order to evaluate and image hydraulic fracture height (HFH) and length (HFL) and/or their lateral extent into far-field or Stimulated Reservoir Area (SRA).

FIGS. 4-6 show logging measurements resulting from the pre- and post-fracturing measurements. The pre-fracturing isotropy is represented by curve 72 in FIG. 4 and anisotropy map 74 in FIG. 5. FIG. 6 includes a log portion 76 showing north-south and east-west images of the natural fractures. As is evident, no significant amounts of anisotropy or significant natural fractures were detected.

DSWI did show significant fracturing as a result of the hydraulic fracturing operation, as is demonstrated by post-fracturing anisotropy curve 78, post-fracturing anisotropy map 80, and log portion 82. The results indicate that the HFH is about 47 feet (ft), the SRA is about 1550 $ft^2$, and the HFL varies with depth. This example demonstrates that evaluating hydraulic fracture stimulation results can be effectively performed using DSWI through casing before and after fracture stimulation.

The systems and methods described herein provide various advantages over existing techniques to create discrete fracture models. DSW allows for imaging of fractures through cased holes over a greater range than other techniques, e.g., 50-60 feet from the borehole or more. The systems and methods also allow for farther field understanding of the effectiveness of fracturing operations in creating complex fracture geometries.

Furthermore, the information generated using the systems and methods described herein can be used to significantly improve formation fracture modeling, as well as improve fracturing and stimulation design.

Generally, some of the teachings herein are reduced to an algorithm that is stored on machine-readable media. The algorithm is implemented by a computer or processor such as the processing unit 32 and/or 48 and provides operators with desired output.

In support of the teachings herein, various analysis components may be used, including digital and/or analog systems. The devices, systems and methods described herein may be implemented in software, firmware, hardware or any combination thereof. The devices may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the devices and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure. The computer executable instructions may be included as part of a computer system or provided separately.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of estimating fractures in an earth formation, comprising:

disposing an acoustic tool in a cased borehole in an earth formation, the acoustic tool including a multipole acoustic transmitter and an acoustic receiver;

transmitting an acoustic signal into the borehole through a casing in the borehole and into the formation;

measuring deep shear wave (DSW) signals through the casing, the DSW signals generated from shear body waves reflected in the formation in a far-field region of the formation around the borehole; and estimating at least a location and an orientation of a fracture in the formation based on the DSW signals.

2. The method of claim 1, further comprising, prior to disposing the acoustic tool in the cased borehole, disposing a stimulation tool in the borehole and performing a hydraulic fracturing operation.

3. The method of claim 2, further comprising evaluating the hydraulic fracturing operation based on the DSW signals and the estimation of the location and the orientation of the fracture.

4. The method of claim 3, further comprising generating a model of a stimulated region of the formation, the model including hydraulic fracture properties estimated based on the DSW signals.

5. The method of claim 1, wherein the method is performed both prior to performing a fracturing operation and after performing the fracturing operation to evaluate the fracturing operation.

6. The method of claim 1, wherein a region of the formation surrounding the borehole includes a near-field region and the far-field region, the near-field region including a region from which flexural waves can be reflected and detected, and the far-field region extending beyond the near-field region.

7. The method of claim 6, wherein the multipole acoustic transmitter includes a cross-dipole transmitter, and transmitting includes generating orthogonally oriented shear waves in the far-field region.

8. The method of claim 7, wherein estimating includes estimating fracture properties in the far-field region and formation anisotropy in the far-field region.

9. The method of claim 8, further comprising inducing borehole flexural waves by the cross-dipole transmitter, and estimating fracture properties and formation anisotropy in the near-field.

10. The method of claim 1, further comprising generating a formation fracture model based on the estimated location and orientation of the fracture.

11. An apparatus for estimating fractures in an earth formation, comprising:

an acoustic tool configured to be disposed in a cased borehole in an earth formation, the acoustic tool including a multipole acoustic transmitter and an acoustic receiver, the acoustic tool configured to transmit an acoustic signal through a casing in the borehole and into the formation, and measure deep shear wave (DSW) signals through the casing, the DSW signals generated from shear body waves reflected in the formation in a far-field region of the formation around the borehole; and a processor configured to estimate at least a location and an orientation of a fracture in the formation based on the DSW signals.

12. The apparatus of claim 11, wherein the acoustic tool is configured to be disposed in the cased borehole after disposing a stimulation tool in the borehole and performing a hydraulic fracturing operation.

13. The apparatus of claim 12, wherein the processor is configured to evaluate the hydraulic fracturing operation based on the DSW signals and the estimation of the location and the orientation of the fracture.

14. The apparatus of claim 13, wherein the processor is configured to generate a model of a stimulated region of the formation, the model including hydraulic fracture properties estimated based on the DSW signals.

15. The apparatus of claim 11, wherein the acoustic tool is configured to be disposed in the borehole and measure DSW signals both prior to performing a fracturing operation and after performing the fracturing operation, and the processor is configured to evaluate the fracturing operation by comparing fracture properties prior to the fracturing operation and fracture properties after the fracturing operation.

16. The apparatus of claim 11, wherein a region of the formation surrounding the borehole includes a near-field region and the far-field region, the near-field region including a region from which flexural waves can be reflected and detected, and the far-field region extending beyond the near-field region.

17. The apparatus of claim 16, wherein the multipole acoustic transmitter includes a cross-dipole transmitter configured to generate orthogonally oriented shear waves in the far-field region.

18. The apparatus of claim 17, wherein the processor is configured to estimate fracture properties in the far-field region and formation anisotropy in the far-field region.

19. The apparatus of claim 18, wherein the cross-dipole transmitter is configured to induce borehole flexural waves, and the processor is configured to estimate fracture properties and formation anisotropy in the near-field.

20. The apparatus of claim 11, wherein the processor is configured to generate a formation fracture model based on the estimated location and orientation of the fracture.

* * * * *